United States Patent [19]

Kirby

[11] 4,142,572

[45] Mar. 6, 1979

[54] SHIELD FOR ELECTROMAGNETIC CASTING

[75] Inventor: James L. Kirby, Mechanicsville, Va.

[73] Assignee: Reynolds Metals Company, Richmond, Va.

[21] Appl. No.: 889,950

[22] Filed: Mar. 24, 1978

[51] Int. Cl.[2] ..... B22D 27/02

[52] U.S. Cl. ..... 164/147; 164/250

[58] Field of Search ..... 164/48, 49, 146, 147, 164/250, 251, 82, 89, 443, 444, 418; 219/10.79, 10.45, 10.57

[56] References Cited

U.S. PATENT DOCUMENTS

| | | | |
|---|---|---|---|
| 3,605,865 | 9/1971 | Getselev | 164/250 |
| 3,702,155 | 11/1972 | Getselev | 164/251 |
| 3,735,799 | 5/1973 | Karlson | 164/147 |
| 3,741,280 | 6/1973 | Kozheurov et al. | 164/49 |
| 3,773,101 | 11/1973 | Getselev | 164/251 |

FOREIGN PATENT DOCUMENTS

| | | | |
|---|---|---|---|
| 267022 | 8/1972 | U.S.S.R. | 164/49 |

*Primary Examiner*—Richard B. Lazarus
*Assistant Examiner*—K. Y. Lin
*Attorney, Agent, or Firm*—Glenn, Lyne, Girard, Clark, and McDonald

[57] ABSTRACT

An inductor/shield assembly for an electromagnetic continuous-casting system comprises a sheet of electrically insulative material coated onto the inner face of a loop-shaped electromagnetic inductor with a tapered shield supported on the insulative material between an electro-magnetic inductor and an ingot being cast. In an embellishment of this embodiment the inductor forms a wall of a coolant box and the inductor, insulative material, and shield define passages through which coolant is sprayed from the coolant box onto an ingot being cast.

10 Claims, 3 Drawing Figures

SHIELD FOR ELECTROMAGNETIC CASTING

BACKGROUND OF THE INVENTION

This invention relates broadly to the art of continuous and semicontinuous metal casting systems, and more particularly, to such systems wherein an electromagnetic inductor serves to shape molten metal prior to solidification thereof.

Prior-art patents disclosing electromagnetic casting systems of the type to which this invention relates include U.S. Pat. Nos. 3,467,166 to Getselev et al., 3,605,865, 3,702,155 and 3,773,101 to Getselev, 3,735,799 to Karlson, and 3,985,179 and 4,004,631 to Goodrich et al. as well as to U.S. Pat. application Ser. No. 728,797 filed Oct. 1, 1976 by Carson et al.

These prior-art patents describe systems for continuously and semicontinuously electromagnetically casting wherein molten metal is introduced at a controlled rate onto a movable bottom block, or pan, located within a loop-shaped electrical inductor. The bottom block is lowered at a controlled rate with metal flow being controlled in accordance with this rate to form an ingot. The molten metal so introduced is confined laterally inside the inductor by an electromagnetic field generated by an alternating current in the inductor. The molten metal is thus formed into a shape in a horizontal plane similar to, but smaller than, the inductor. The emerging bottom block and ingot are subjected to rapid cooling by the application of a coolant, such as water, to solidify the ingot into this shape.

In most of these type systems there is a tapered electromagnetic shield or screen located inside the inductor arranged coaxially therewith made of a non-magnetic, but electrically conductive, metal, such as stainless steel. The shield, because of its taper, serves to attenuate the magnetic field of the inductor upwardly, thereby lessening the electromagnetic forces restraining the ingot at the top as opposed to those at the lower edge of the shield. The advantages of such a shield are more fully described in U.S. Pat. No. 3,605,865 to Getselev, and the information in that patent is incorporated by reference herein.

In practice, these shields get quite hot during operation because of their close proximity to molten metal forming the ingot and because they absorb so much energy from the electromagnetic field of the inductor. Thus, the shields must often be cooled by spraying coolant onto them. This heating and cooling of the shields often causes warping thereof to create nonuniformity in the attenuation of the electromagnetic field and to vary the impingement of coolant falling from such warped shields onto the ingots being cast. It is therefore an object of this invention to provide mounting supports for continuous-casting, electromagnetic shields which help prevent the warping thereof.

The shields must be relatively rigid so that they can be positioned uniformly between an ingot being cast and the inductor. Thus, it is an object of this invention to provide a mounting for a shield of an electromagnetic casting apparatus which holds the shield sturdily and rigidly to maintain it in a proper shape and position.

It is a further object of this invention to provide such a shield for an electromagnetic casting system which is easy to mount.

As is noted above, the coolant which is sprayed onto the shield to cool it is often a problem in that it falls onto ingots being cast in a nonuniform manner. Further, if this coolant is dropped straight downwardly without impinging on the ingot it sometimes interferes with coolant being sprayed independently onto the ingot. Thus, it is another object of this invention to provide a system for cooling a shield with a coolant which provides uniform coolant flow onto ingots being cast and which does not interfere with independently sprayed coolant.

It is also an object of this invention to provide a shield which is economical and uncomplicated to manufacture.

SUMMARY OF THE INVENTION

According to principles of this invention, a shield for an electromagnetic casting system is mounted on, and supported by, a sheet of electrically insulative material which is coated onto the inner surface of the inductor. In one embodiment, the inductor is solid and forms the inner wall of a coolant box. An embellishment of this embodiment is that the inductor, insulative material, and shield form passages therethrough, through which coolant is sprayed from the coolant box onto the ingot being cast.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF PREFERRED EMBODIMENTS

Figure 1:
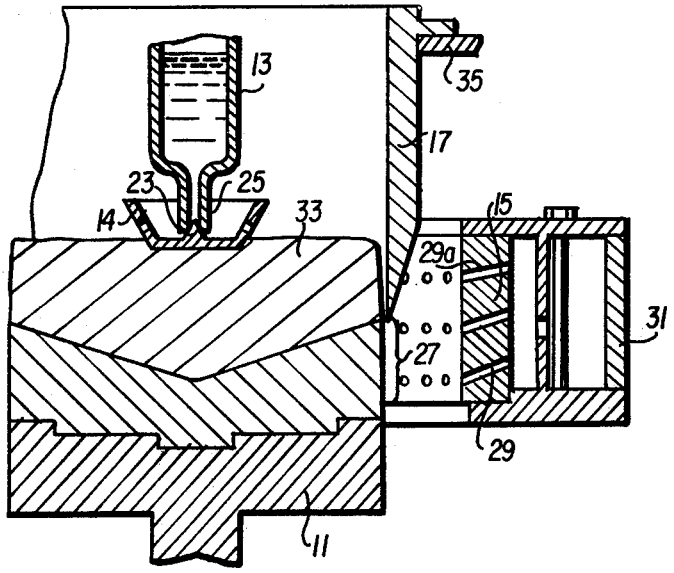
FIG. 1 (PRIOR ART)
FIG. 1 is a fragmented cross-sectional view of a prior-art electromagnetic casting system.

Referring now to FIG. 1, which shows a prior-art electromagnetic continuous casting apparatus, this device comprises a movable bottom block or pan 11, a supply spout 13 controlled by a float 14 or other means, a loop-shaped solid inductor 15, and a stainless steel ¼ inch thick shield 17. In overall operation, molten metal flows from the supply spout 13 via the float 14 onto the bottom block or pan 11. The float 14 has a cone-shaped valve portion 23 positioned in a nozzle 25 of the supply spout 13 to regulate the amount of molten metal fed onto the pan 11.

The molten pan is maintained in an appropriately shaped column by the electromagnetic and electrostatic forces created by alternating current in the solid inductor 15. The manner in which this is achieved is described in the above mentioned prior-art patents and will therefore not be described in greater detail here.

Coolant, such as water, is sprayed onto the molten metal at an impingement zone 27 and this can be accomplished, as is shown in FIG. 1, by spraying through passages 29 in the solid inductor 15. In this respect, the solid inductor 15 forms a wall of a loop-shaped coolant box 31 which is supplied with a coolant (supply apparatus not shown) so as to provide a "water-through-inductor" coolant system.

It should be noted that in the prior-art system, coolant is sprayed not only on the molten metal at the impingement zone 27 but is also sprayed onto the backside of the shield 17 from a passage 29*a*. A purpose in spraying coolant onto the shield is to keep the shield cool because the shield gets hot from its close proximity to molten metal 33 and from energy that is absorbed from the electromagnetic field created by the solid inductor 15. Such shields are normally around ¼ inch thick in order to maintain their rigidity. In the FIG. 1 embodiment, the shield 17 is supported from above on a fixed support 35.

Figure 2:
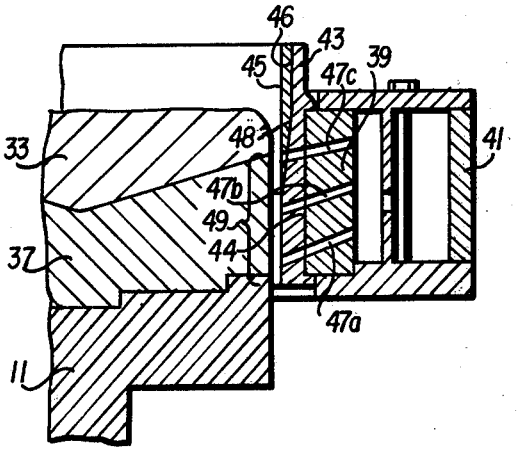
FIG. 2 is a fragmented cross-sectional view of an electromagnetic casting system employing principles of this invention.

With reference to FIG. 2, a similar electromagnetic continuous casting system is depicted including a pan 11 having molten metal 33 deposited thereon to form a solidified ingot 37. This apparatus also includes a solid inductor 39 which forms the inner wall (the wall facing the ingot) of a coolant box 41. However, in this assembly, a sheet of an insulative material 43 is coated onto the inner surface of the solid inductor 39 and a shield 45 is mounted onto the inner surface 46 of the sheet of insulative material 43. In this respect, the insulative material 43 is shaped to form a shoulder 48 on which the shield 45 rests. In this embodiment the shield 45 is tightly fitted in the insulative material 43. The insulative material 43 is a porcelain enamel which is baked onto the inner surface 44 of the inductor in the same manner as porcelain enamel is baked onto a sink. The shield 45 is tapered on an angle of approximately 15° with the vertical extending from the top of the inductor 39 to the mid-point, or center line, thereof.

In the FIG. 2 embodiment, the solid inductor 39 provides radial support for the sheet of insulative material 43 and the sheet of insulative material 43, in turn, provides radial support for the shield 45. Thus, the shield 45, is adequately supported radially to inhibit its warping and to maintain it in a stable position between the solid inductor 39 and the molten metal 33.

Coolant spray pasages 47*a–c* are provided through the solid inductor 39, the sheet of insulative material 43, and the shield 45 for spraying coolant from the coolant box 41 onto an impingement zone 49 of the ingot 37. Coolant passing through the passageway 47C comes in contact with the shield 45 when it passes through the shield and thereby cools it. At the same time this coolant provides a uniform spray on the ingot 37 at the impingement zone 49. It is important that at least one set of coolant passageways 47 go through the shield to help cool it. Some of these holes must be spaced from the feathered bottom edge of the shield 45 if they are expected to most effectively perform their necessary function of cooling the shield.

It will be appreciated by those skilled in the art that the shield assembly depicted in FIG. 2 is particularly advantageous in that, for one thing, it can allow a thinner shield than was normally used in the prior art to be used which will absorb significantly less energy than the thicker shields previously used, but yet it provides position stability for the thinner shield.

Also, it should be noted that with this arrangement, it is possible to locate the solid inductor 39 closer to the ingot 37 being cast because the elements are so compact. Thus, again, since the inductor is close to the ingot, less energy is required to drive the system.

In addition, by passing coolant through the shield the shield is cooled while a uniform water spray is simultaneously provided on the ingot.

Figure 3:
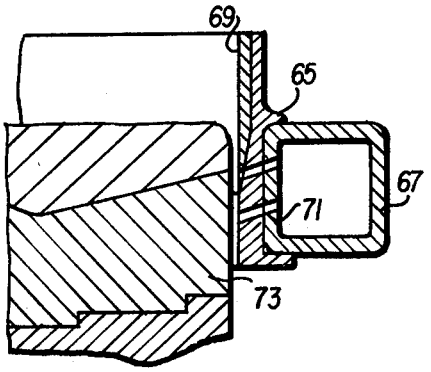
FIG. 3 is a fragmented, cross-sectional third embodiment of an electromagnetic casting system employing principles of this invention.

In the FIG. 3 embodiment, a sheet of insulative material 65 is adhered to a hollow inductor 67 and a thin stainless-steel shield 69 is mounted onto the sheet of insulative material 65. Again, there are coolant spray passages 71 extending through the interior wall of the hollow inductor 67, the sheet of insulative material 65, and the shield 69 for spraying coolant onto an ingot 73.

While this invention has been particularly shown and described with reference to preferred embodiments, it will be understood by those skilled in the art that various changes in form and detail may be made therein without departing from the spirit and scope of the invention. For example, in another embodiment, the porcelain enamel is actually adhered to the shield 45 by baking it onto the shield.

The insulative material 43 is a polymer in another embodiment.

In one embodiment, a thin shield 45 is cohered to the sheet of insulative material 43 by depositing it onto the sheet of insulative material 43 by vapor deposition, ion deposition, electroplating, or some other similar deposition process. In this embodiment the shield is normally less than 0.010 inch thick at the thickest part. Although such a shield 45 is so thin that it is not structurally strong by itself, it is fully supported by the insulative material 43. In this embodiment, it is particularly important that at least one set of coolant spray passages 47 extend through the shield 45 to cool it.

I claim:

1. In an electromagnetic continuous casting system of the type including a molten-metal supply means for continuously supplying molten metal to a first end of an ingot being cast at a casting station, a means for moving a second end of the ingot away from the supply means, a loop-shaped inductor surrounding the ingot at said casting station for creating an electromagnetic field at said casting station to shape said molten metal, and an electrically conductive shield positioned between said loop-shaped inductor and said ingot;

the improvement wherein is further included a sheet of electrically insulative material cohered to the inner surface of said loop-shaped inductor at substantially all contiguous surfaces, said shield also being cohered to the inner surface of said sheet of insulative material at substantially all contiguous surfaces, whereby the inductor, insulative material, and shield form a composite member.

2. In an electromagnetic continuous casting system as in claim 1 wherein said shield is sufficiently thin that it is not strong enough to support its shape during operation of said electromagnetic continuous casting system without being cohered to said insulative material.

3. In an electromagnetic continous casting system as in claim 2 wherein said inductor is solid and forms the inner wall of a coolant box, said inductor and said insulative material defining passages extending from the interior of said coolant box to the exterior thereof for spraying coolant from said coolant box onto said ingot being cast.

4. In an electromagnetic continuous casting system as in claim 3 wherein said inductor, said insulative material and said shield define passages extending from the interior of said coolant box to the exterior thereof for spraying coolant from said coolant box onto ingots being cast therewith.

5. A loop-shaped coolant box means for an electromagnetic continuous casting system for transporting coolant around, and spraying coolant onto, an ingot being cast, said coolant box including an inner wall formed of an electromagnetic solid inductor, an electrically-insulative material coated on the inner surface of said inductor and being cohered to said solid inductor at substantially all contiguous surfaces, and a nonmagnetic, electrically-conductive metal cohered to the inner surface of said insulative material at substantially all contiguous surfaces to form a shield between said inductor and an ingot being cast therewith.

6. A loop-shaped coolant box means for an electromagnetic continuous casting system as in claim 5 wherein said inductor, said insulative material, and said shield define passages therethrough which coincide with one another for spraying coolant from said coolant box onto ingots being cast therewith.

7. A loop-shaped coolant box means for an electromagnetic continuous casting system as in claim 5 wherein said shield is thinly coated on the inner surface of said sheet of insulative material by a deposition process.

8. In an electromagnetic continuous casting system as in claim 2 wherein the shield is less than approximately 0.010 inch thick.

9. A loop-shaped coolant box means as in claim 5 wherein said shield is sufficiently thin that it is not strong enough to support its shape during operation of said electromagnetic continuous casting system without being cohered to said insulative material.

10. A loop-shaped coolant box means as in claim 9 wherein said shield is less than 0.010 inch thick.

* * * * *